US008468832B2

(12) United States Patent
Dodo et al.

(10) Patent No.: US 8,468,832 B2
(45) Date of Patent: Jun. 25, 2013

(54) COMBUSTOR, METHOD OF SUPPLYING FUEL TO SAME, AND METHOD OF MODIFYING SAME

(75) Inventors: Satoshi Dodo, Kasama (JP); Keisuke Miura, Mito (JP); Kazuhito Koyama, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 981 days.

(21) Appl. No.: 12/543,308

(22) Filed: Aug. 18, 2009

(65) Prior Publication Data

US 2010/0064694 A1 Mar. 18, 2010

(30) Foreign Application Priority Data

Sep. 12, 2008 (JP) ..... 2008-234169

(51) Int. Cl.
*F02C 3/22* (2006.01)
*F23R 3/12* (2006.01)

(52) U.S. Cl.
USPC ..... 60/737; 60/748; 60/746

(58) Field of Classification Search
USPC ..... 60/737, 748, 746, 747
See application file for complete search history.

(56) References Cited

U.S. PATENT DOCUMENTS

| | | | | |
|---|---|---|---|---|
| 4,408,461 | A | 10/1983 | Bruhwiler et al. | |
| 6,289,677 | B1 * | 9/2001 | Prociw et al. | 60/748 |
| 6,863,228 | B2 * | 3/2005 | Mao et al. | 60/748 |
| 2004/0011054 | A1 | 1/2004 | Inoue et al. | |
| 2009/0031728 | A1 * | 2/2009 | Miura et al. | 60/737 |
| 2009/0293484 | A1 * | 12/2009 | Inoue et al. | 60/740 |

FOREIGN PATENT DOCUMENTS

| | | | |
|---|---|---|---|
| EP | 0 029 619 | | 6/1981 |
| EP | 1 402 956 | A2 | 3/2004 |
| EP | 1 489 358 | A2 | 12/2004 |
| EP | 1 596 133 | A1 | 11/2005 |
| EP | 1912022 | A2 * | 4/2008 |
| JP | 07-248118 | | 9/1995 |
| JP | 2003-148734 | A | 5/2003 |

OTHER PUBLICATIONS

JP 7-248118 Sep. 1995, machine translation.*
European Patent Office extended search report on application No. 09168216.1 dated Mar. 17, 2011; 7 pages.

* cited by examiner

*Primary Examiner* — Ted Kim
(74) *Attorney, Agent, or Firm* — Foley & Lardner LLP

(57) ABSTRACT

An object of this invention is to suppress adhesion of a flame to periphery of air hole outlets arranged on an air hole plate. A combustor includes a fuel nozzle for jetting out a fuel into a combustion chamber formed at a downstream side; an air hole plate of a flat-plate shape disposed between the fuel nozzle and the chamber, the air hole plate facing an upstream side of the chamber; and a plurality of air holes provided in the air hole plate, in a circumferential direction relative to a central axis of the air hole plate, such that a fuel flow and an air flow formed at an outer circumferential side of the fuel flow are blown out into the chamber from the respective air holes; wherein a clearance defined between any two circumferentially adjacent air hole inlets provided on a face of the air hole plate that is nearer to the fuel nozzle is wider than a clearance defined between any two circumferentially adjacent air hole outlets formed on a face of the air hole plate that is nearer to the chamber. According to the invention, adhesion of a flame to peripheral sections of the air hole outlets disposed on the air hole plate can be suppressed.

2 Claims, 10 Drawing Sheets

Cross-section along the line X-X

Cross-section along the line Y-Y

θ-1
θ-2
θ-3
b-1
b-2
b-3
t
D0
D1-1
D1-2
D1-3
D2-1
D2-2
D2-3
20
21-1
21-2
21-3
a-1
a-2
a-3

COMBUSTOR, METHOD OF SUPPLYING FUEL TO SAME, AND METHOD OF MODIFYING SAME

This application claims priority from Japanese Patent Application 2008-234169, filed Sep. 12, 2008 which is incorporated herein by reference in its entirety.

BACKGROUND OF THE INVENTION

1. Field of the Invention

The present invention relates to a combustor, a method of supplying a fuel to the combustor, and a method of modifying the combustor.

2. Description of the Related Art

Among the power-generating plants that support the electric power required for industrial applications are gas turbine power plants fueled by fossil resources such as natural gas or petroleum. These gas turbine power plants, fueled by fossil resources, emit carbon dioxide ($CO_2$) that is a global warming substance, and are therefore required to have their power-generating efficiency improved more than ever before. Methods of improving power-generating efficiency include enhancing the temperature of the combustion gas emitted from a gas turbine combustor. Enhancing the temperature of the combustion gas, however, exponentially increases the quantities of nitrogen oxides (NOx) contained in the combustion gas, each of these nitrogen oxides being an environmentally harmful substance. It is an important technical challenge, therefore, how to reduce NOx while at the same time achieving higher power-generating efficiency.

Accordingly, JP-2003-148734-A discloses a technique for disposing an air hole plate between a fuel nozzle and a combustion chamber and blowing out jets of fuel and jets of air formed at an outer circumferential side of the fuel flows, inside air holes provided in the air hole plate, into the chamber. According to the combustor of JP-2003-148734-A, NOx can be reduced by enhancing dispersibility of the fuel with respect to the air.

SUMMARY OF THE INVENTION

For the air hole plate in JP-2003-148734-A, air hole outlets formed on the plate face nearer to the chamber are arranged side by side in a circumferential direction relative to a central section of the air hole plate. A clearance is present between any two circumferentially adjacent air hole outlets, and a trailing vortex occurs around the clearance. The clearance and the trailing vortex have caused a flame to adhere to the plate face in some cases. The event of the flame adhesion to the plate face has resulted in the fuel and the air being burned in an insufficiently mixed condition, and has thus caused local increases in combustion temperature and hence, increases in NOx. In addition, the combustion of the fuel at an immediately neighboring region of the air hole plate face nearer to the chamber has increased the air hole plate in temperature. Furthermore, deformation of the flame due to the fuel flows has caused pressure changes and the like.

An object of the present invention is to suppress adhesion of a flame to peripheral sections of air hole outlets disposed on an air hole plate.

A combustor of the present invention includes: a fuel nozzle for jetting out a fuel into a combustion chamber formed at a downstream side; an air hole plate of a flat-plate shape disposed between the fuel nozzle and the chamber, the air hole plate facing an upstream side of the chamber; and a plurality of air holes provided in the air hole plate, in a circumferential direction relative to a central axis of the air hole plate, such that a fuel flow and an air flow formed at an outer circumferential side of the fuel flow are blown out into the chamber from the respective air holes; wherein a clearance defined between any two circumferentially adjacent air hole inlets provided on a face of the air hole plate that is nearer to the fuel nozzle is wider than a clearance defined between any two circumferentially adjacent air hole outlets formed on a face of the air hole plate that is nearer to the chamber.

According to the present invention, adhesion of a flame to peripheral sections of the air hole outlets disposed on the air hole plate can be suppressed.

DESCRIPTION OF THE PREFERRED EMBODIMENTS

Embodiments of the present invention will be described below.

(First Embodiment)

Figure 3:
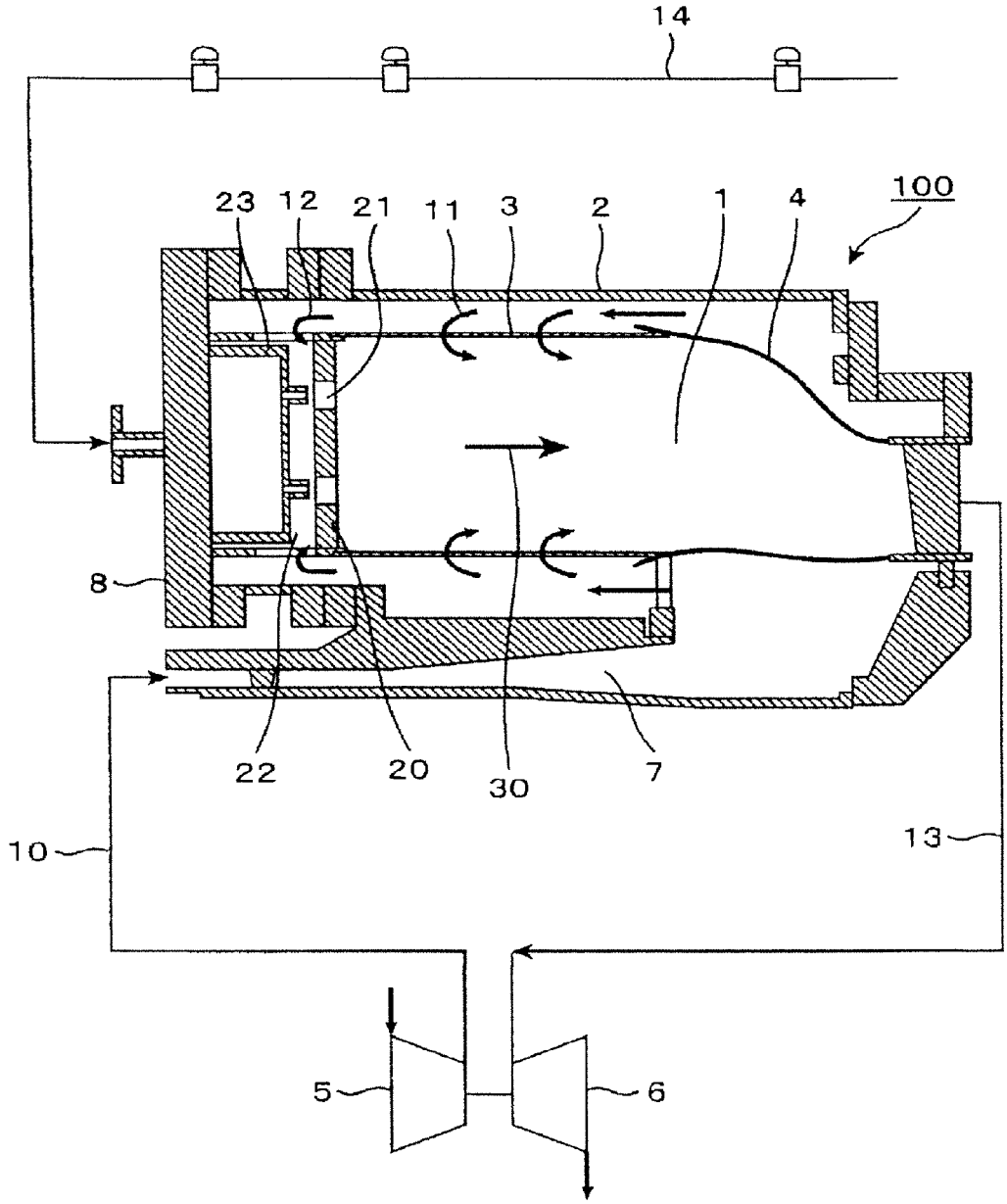
FIG. 3 is a diagram showing a cross section of the combustor in the first embodiment, and a system of a compressor and turbine therein.

FIG. 3 is a schematic block diagram of a gas turbine system employing a combustor 100 according to an embodiment of the present invention.

Compressed air 10 that has been generated by a compressor 5 flows into a casing 7 of the combustor 100.

Internally to a combustor outer casing 2, the combustor 100 includes a combustor liner 3 for burning a mixture 30 of a fuel and air, inside the combustor 100, and a combustion chamber 1 formed internally to the combustor liner 3. The compressed air 10, after being supplied from the compressor 5, passes through a space between the combustor outer casing 2 and the combustor liner 3, and part of the compressed air 10 becomes cooling air 11 to cool the combustor liner 3. The remaining compressed air 10 enters a space between a combustor end cover 8 and an air hole plate 20, as combustion air 12. Meanwhile, a fuel 14 flows into a fuel divider 23 from the outside of the combustor end cover 8, and then the fuel is jetted out from a fuel nozzle 22 disposed at an upstream side of the air hole plate 20. The air hole plate 20 includes a plurality of air holes 21 arranged in a circumferential direction relative to a central axis of the air hole plate. The fuel flow and air flow that have been blown out from each air hole 21 form a flame in the chamber 1. After this, a combustion gas 13 flows through a combustor transition piece 4 and then enters a turbine 6 to drive an electric power generator, for example.

Figure 10:
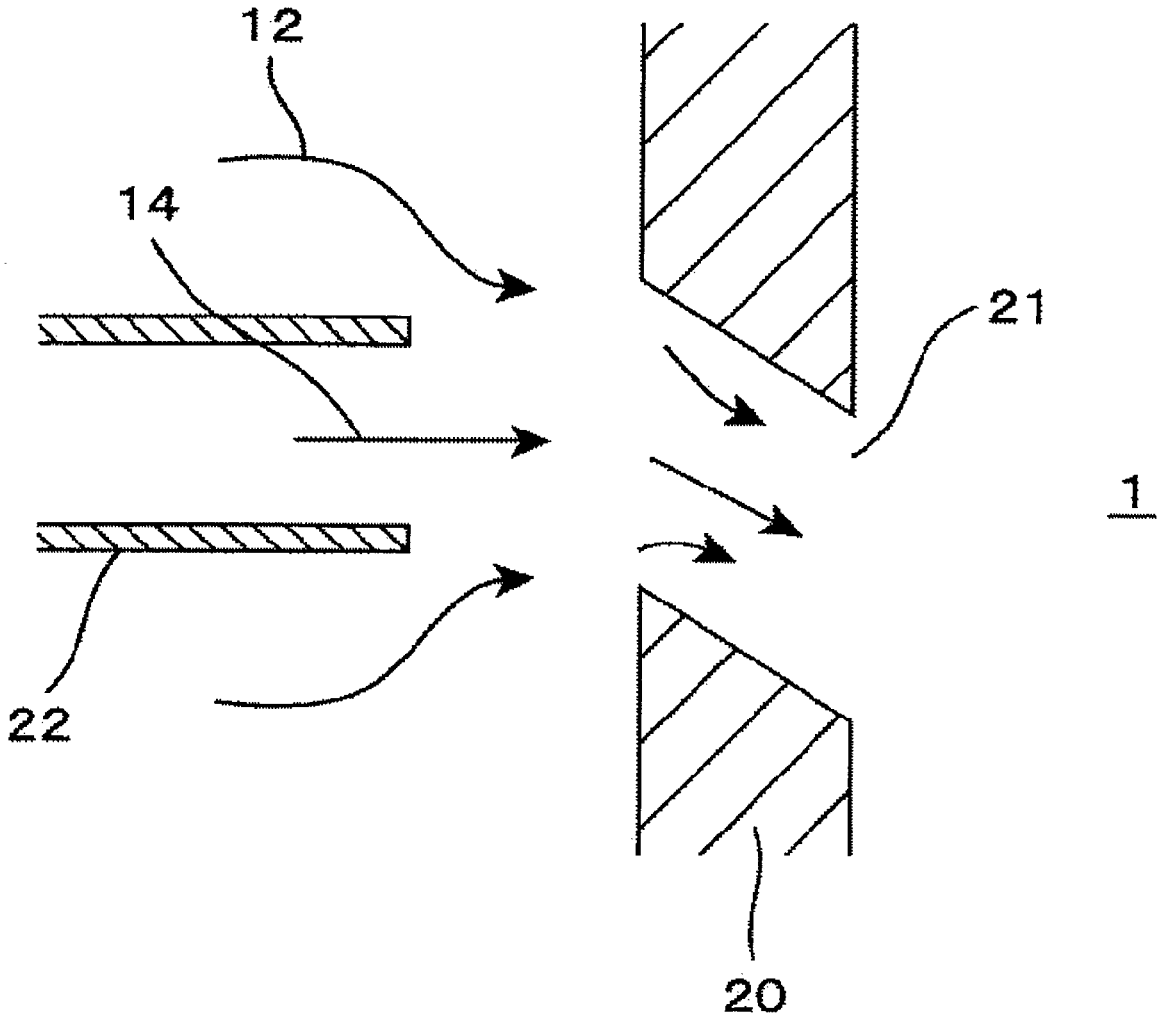
FIG. 10 is an enlarged view of a distal end of a fuel nozzle.

FIG. 10 is an enlarged view of a distal end of the fuel nozzle 22. The air hole plate 20 of a flat-plate shape is disposed between the fuel nozzle 22 and the chamber 1. At the upstream side of the air hole plate 20, the compressed air 10 from the compressor 5 is drawn into the upstream side from the air hole plate 20. The fuel nozzle 22 is disposed at an upstream side of the air hole 21. The fuel 14 jetted out from the fuel nozzle 22, therefore, flows into the air hole 21. The combustion air 12 supplied from the upstream side of the air hole plate 20 also flows into the air hole 21 from an outer circumferential side of the fuel nozzle 22. At this time, the combustion air 12 flows into the air hole 21, a narrow space, from a wide space formed at the upstream side of the air hole plate 20. Inside the air hole 21, therefore, annular airflows formed at outer peripheral sides of both the fuel flow and the air flow are considered to flow towards the chamber 1. Upon passing through the air hole 21, the fuel flow and the air flow burst out into the chamber 1 having a wider space than the air hole 21. Thus, the fuel flow and the air flow are rapidly mixed in the chamber 1.

In this combustor configuration with the plurality of air holes in the air hole plate and the fuel nozzle at the upstream side of each air hole, the fuel that has flown into the chamber disperses rapidly and this, in turn, increases a degree of mixing between the fuel and the air, allowing rapid mixing at a short distance. Such a configuration is characterized in that since the fuel flow flows centrally inside the air hole and since the air flow flows around the fuel flow, the combustor prevents a combustible mixture from being formed at an immediately neighboring region of the fuel nozzle. This configuration is also characterized in that since mixing progresses in a very narrow internal region of the air hole, the combustion gas eludes entry into the air hole and hence, flash-back.

In the fuel nozzle vs. air hole positional relationship shown in FIG. 10, the air hole 21 has a central axis inclined in a circumferential direction of the air hole plate 20. The fuel flow and air flow from the air hole 21 are therefore injected into the chamber 1 along a central axis of the air hole 21. Since the air hole 21 is inclined in this form in the circumferential direction of the air hole plate 20, the fuel flow and air flow blown out from the air hole 21 each become a swirling flow that streams to a downstream side while swirling spirally inside the chamber 1. In addition, since the central axis of the air hole 21 is inclined in the circumferential direction of the air hole plate 20, a slight deviation in fuel concentration remains inside the air hole. The swirling flows jetted out from the air hole 21 form a stable flame since the slight deviation in fuel concentration remains.

Figure 1A:
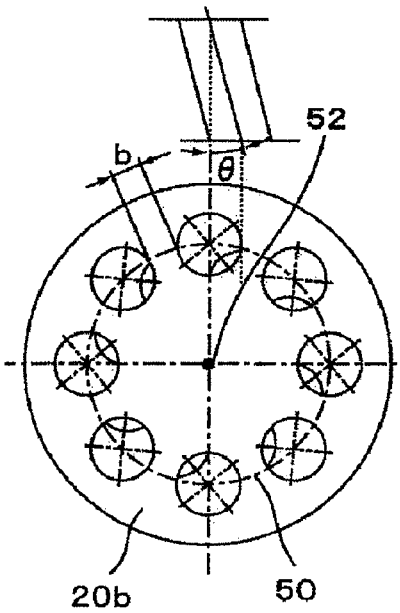
FIGS. 1A to 1D are structural views showing an air hole plate in a first embodiment.
Figure 1B:
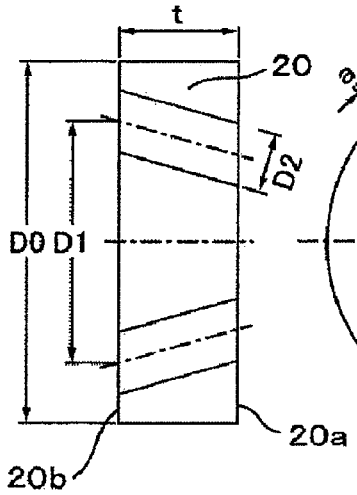
Figure 1C:
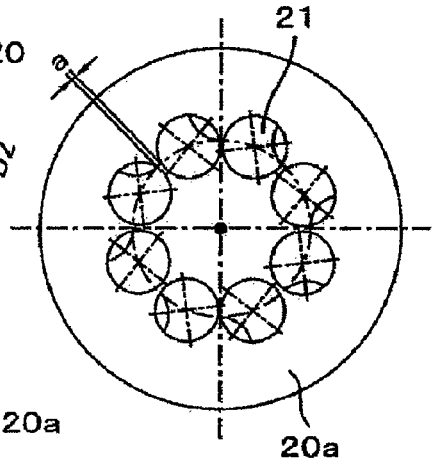

FIGS. 1A, 1B, 1C, and 1D show the air hole plate 20. FIG. 1A shows the air hole plate 20 as viewed from a direction of the fuel nozzle, FIG. 1B is a sectional view of the air hole plate as viewed perpendicularly to a plate face nearer to the chamber, and FIG. 1C shows the air hole plate 20 as viewed from a direction of the chamber. Reference number 20*a* in FIG. 1B denotes the face of the air hole plate that is nearer to the chamber, and reference number 20*b* denotes a plate face nearer to the fuel nozzle.

Circumferentially adjacent air hole inlets, each with a clearance at both sides, are provided on the face of the air hole plate that is nearer to the fuel nozzle. These clearances are shown in FIG. 1A. Circumferentially adjacent air hole outlets, each with a clearance at both sides, are provided on the face of the air hole plate that is nearer to the chamber. These clearances are shown in FIG. 1C. In FIG. 1B, the fuel nozzle is located to the left of the plate face 20*b* nearer to the fuel nozzle. The air holes can have a non-circular shape (e.g., a rectangular-slot shape).

Figure 1D:
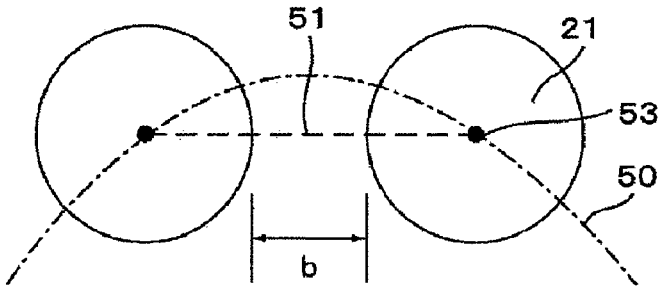

FIG. 1D is an enlarged view of two air holes 21 provided on the plate face nearer to the fuel nozzle. The air holes 21 each have an inlet face center 53 disposed on a curve of a circumference 50 with respect to a central point 52 of the plate face 20*b* nearer to the fuel nozzle. Referring to the two adjacent air holes 21, of an entire straight line 51 connecting the respective two inlet face centers 53, only a rectilinear portion "b", except for the portions of the line 51 that lie on the inlet faces of the air holes, can be defined as a clearance between the air hole inlets. A clearance between the air hole outlets can also be defined similarly to the clearance shown in FIG. 1D.

As shown in FIGS. 1A, 1C, eight air holes 21 are opened centrally in the air hole plate 20. The clearance between any two air hole outlets on the face 20*a* of the air hole plate 20 that is nearer to the chamber is expressed as "a", the clearance between any two air hole inlets on the air hole plate face 20*b* nearer to the fuel nozzle, as "b", and thickness of the air hole plate 20, as "t". In addition, a swirling angle θ assigned to each air hole is defined by an angle formed between a plane formed so that the face of the air hole plate that includes the central axis of the air hole, and a plane orthogonal to the particular face of the air hole plate.

Figure 2:
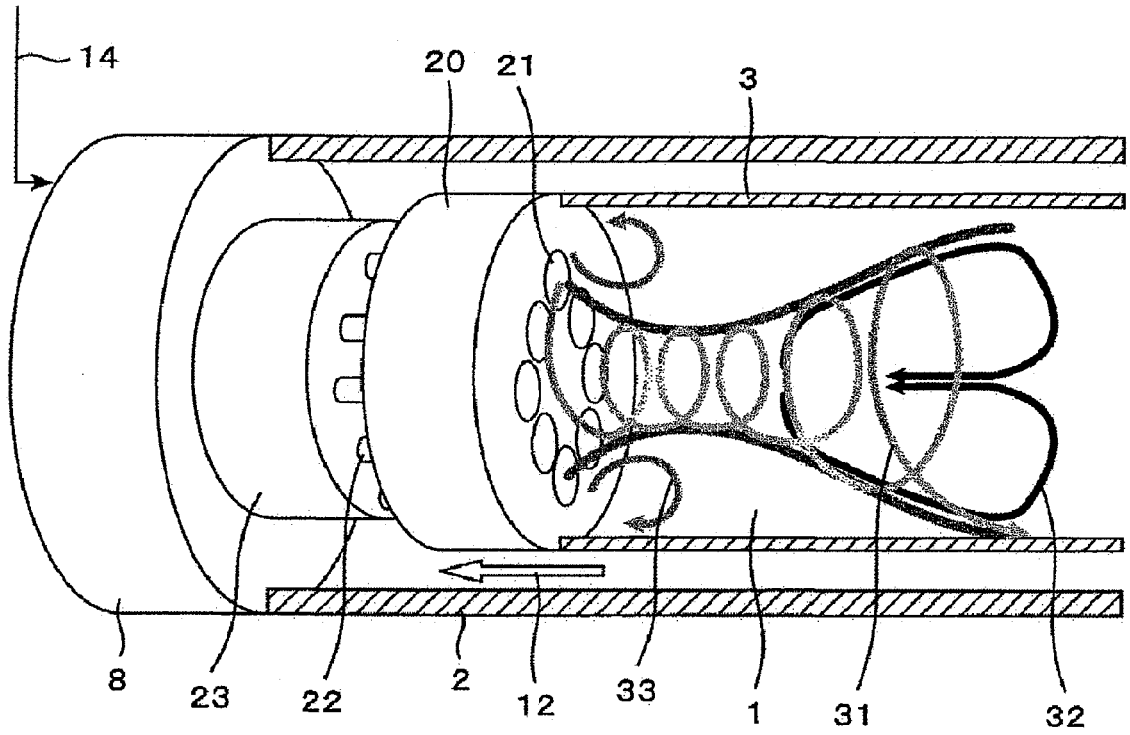
FIG. 2 shows a schematic structure of a combustor and directions of flow of a fuel flow and air flow in the combustor.

FIG. 2 shows a schematic structure of the combustor 100 and the directions of flow of the fuel flow and air flow in the combustor. In the present embodiment, the clearance "b" between any two circumferentially adjacent air hole inlets on the air hole plate face 20*b* nearer to the fuel nozzle is wider than the clearance "a" between any two circumferentially adjacent air hole outlets on the air hole plate face 20*a* nearer to the chamber. Since the foregoing relationship exists between the clearance of the air hole inlets and that of the air hole outlets, the swirling flows 31 jetted out from the air hole plate 20 swirl spirally while approaching each other, with swirling radii of the swirling flows 31 gradually diminishing. Further downstream traveling of the swirling flows 31 extends the swirling radii. The extension of the swirling radii leads to creating an adverse pressure gradient region in which a decrease in pressure is augmented from the downstream side, towards the upstream side, at a central axis of the chamber. As a result, part of the burnt mixture flows backward towards the air hole plate as circulating flows 32. In addition, at neighboring regions of the air holes 21 where the swirling flows 31 are jetted out, vortices, called wake flows 33, occur since surrounding air moves in the form of being trailed by the swirling jets.

Figure 4A:
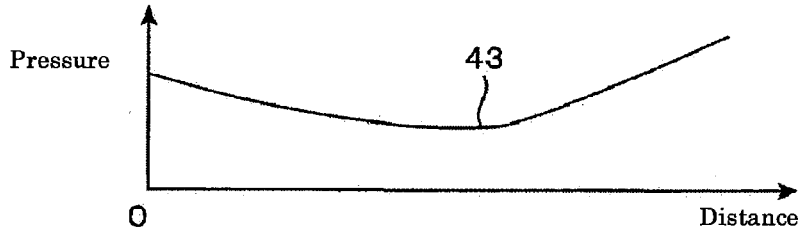
FIGS. 4A to 4D are diagrams showing an overview of the flows within the combustor of the first embodiment.
Figure 4B:
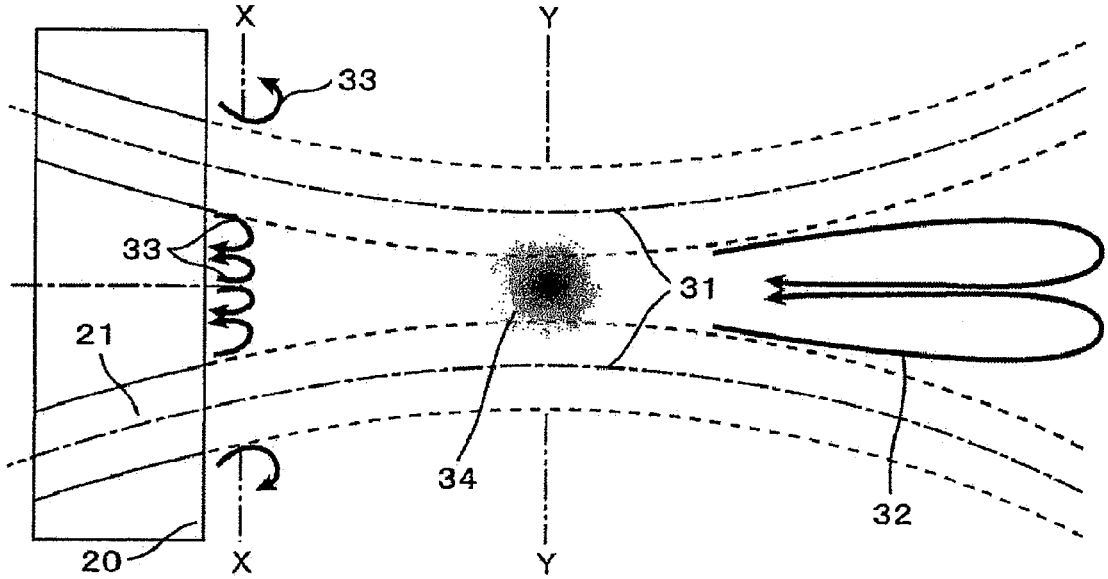
Figure 4C:
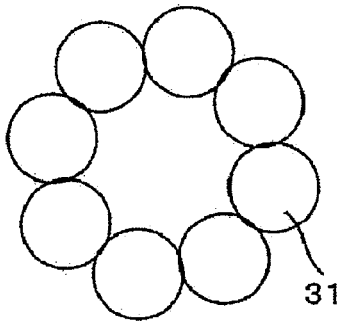
Figure 4D:
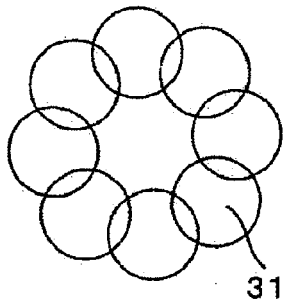

FIG. 4B shows a flow pattern of the swirling flows 31 jetted out from the air holes 21. FIG. 4A is an in-chamber distribution curve of pressure at the central axis of the burner in FIG. 4B. FIGS. 4C and 4D show the swirling flows 31 in sectional view along lines X-X and Y-Y, respectively, of FIG. 4B.

The curve of FIG. 4A is shown with an origin 0 positioned on the air hole plate face 20*a* nearer to the chamber. Also, a distance from the air hole plate face 20*a* nearer to the chamber is plotted on a horizontal axis, and pressure in the chamber at the central axis of the burner, on a vertical axis. At an axial position X in FIG. 4B, the plurality of swirling flows 31 meet each other to form one circular or annular jet of fuel-air mixture. Additionally, since the distance between the jets further narrows down during the downstream movements of the swirling flows towards the chamber, the swirling radii of the jets become small, compared with those of the jets existing immediately after leaving the air holes. The decreases in the swirling radii of these jets increase swirling-directional velocity components of the jets, pursuant to the law of conservation of angular momentum. When the swirling-directional velocity components are increased, a favorable pressure gradient that as represented by the pressure distribution 43 in FIG. 4A, reduces pressure in the direction from the air hole plate 20, towards an outlet of the combustor, is created near a central axis of the combustor immediately after the swirling flows have exited the air hole outlets. The favorable pressure gradient makes the wake flows 33 appear at the outer peripheral side of the air hole plate.

The swirling radii of the above swirling jets are minimized at an axial position Y. The swirling radii start to increase downstream from the axial position Y. Therefore, as can be seen from the pressure distribution 43 near the central axis of the combustor, the adverse pressure gradient occurs that increases pressure from the axial position Y, towards the combustor outlet. Accordingly, the circulating flows 32 resulting from the counter flow of part of the burnt mixture towards the axial position Y are formed, and the circulating flows 32 serve as a firing source to maintain a steady flame state.

At a neighboring section of the axial position Y, a stagnation region 34 substantially free from changes in pressure is formed because of the swirling flows 31 changing the respective swirling radii very insignificantly. In the present embodiment, the axial position Y that the circulating flows 32 reach is far from the air hole plate 20. Even if a combustible mixture exists at the wake flows 33 or other regions immediately neighboring the air hole plate, therefore, a high-temperature combustion gas to become a firing source is present in the distance, between the favorable pressure gradient region and the stagnation region 34. In addition, since the circulating flows 32 are enveloped in the swirling flow 31 that was created into a circular or annular shape by the mutual convergence between the original swirling flows, no flame can adhere to the wake flows 33, for example, that exist near the air holes. For these reasons, local high-temperature combustion due to combustion of an incomplete mixture does not occur near the air hole plate 20. This characteristic allows suppression of flame adhesion to peripheral sections of the air hole outlets disposed on the air hole plate, and in addition, local high-temperature combustion is suppressed near the air hole plate. A low-NOx, high-reliability combustor can therefore be obtained.

In particular, for a gas turbine combustor that burns the by-product gases occurring at oil refineries, the cokes furnace gases obtained in cokes furnaces, and/or other hydrogen-containing fuels, the hydrogen tends to increase burning rates of flames significantly, thus easily permitting a flame to adhere to a clearance between two circumferentially adjacent air hole outlets. Accordingly, when the foregoing fuel is burned in the present embodiment, flames can be prevented from adhering particularly to the clearance between any two circumferentially adjacent air hole outlets, and to a peripheral region of the clearance.

Next, angularity of the air holes in FIGS. 1A to 1D is described below. In the present embodiment, when the number of air holes is taken as N, the thickness of the air hole plate, as "t", a diameter of the air holes, as D2, and the clearance between any two air hole outlets on the air hole plate face nearer to the chamber, as "a", the relationship shown in the following formula (1) is satisfied:

$$N > \frac{1}{0.615\left(\frac{D2}{t}\right) + 0.594\left(\frac{a}{t}\right)} \qquad \text{Formula 1)}$$

In addition, the clearance b" between any two air hole inlets provided on the air hole plate face nearer to the fuel nozzle takes a value falling within the range defined by formula (2) also assuming that the number of air holes is N, the thickness of the air hole plate is "t", the diameter of the air holes is D2, and the clearance between any two air hole outlets on the air hole plate face nearer to the chamber is "a". In the present embodiment, it follows that (D2/t)=0.5, (a/t)=0.03, and N=8. Even when the number of air holes is other than 8, however, provided that N>3.08, formula (1) is satisfied. Essentially the same effects as those described above can therefore be obtained by arranging at least four air holes and adopting the air hole clearances defined by the following formula (2):

$$\frac{1}{\left\{0.786\left(\frac{a}{t}\right)^5 - 2.46\left(\frac{a}{t}\right)^4 + 2.98\left(\frac{a}{t}\right)^3 - 1.79\left(\frac{a}{t}\right)^2 + 0.581\left(\frac{a}{t}\right) + 0.0115\right\} N \times a} < \frac{1}{b} \qquad \text{Formula 2)}$$

$$\frac{1}{b} < \frac{1}{\left\{0.105\left(\frac{a}{t}\right)^3 - 0.247\left(\frac{a}{t}\right)^2 + 0.226\left(\frac{a}{t}\right) + 0.00215\right\} N \times a}$$

Although (a/t)=0.113 is obtained in the present embodiment, essentially the same effects as above can be obtained if any other value falling within a range of 0.070<(a/t)<0.219 and satisfying formula (2) is assigned to the clearance "b".

In addition, the swirling angle imparted to the air holes is smaller than the angle defined below by formula (3). While the present embodiment assumes a swirling angle value of θ=15°, essentially the same effects as those described above can be obtained if any other such angle less than 39.5° that satisfies formula (3) is assigned alternatively.

$$\theta < \sin^{-1}\left[\left\{-0.232\left(\frac{a}{t}\right) + 0.156\right\}\left(\frac{D2}{t}\right)N + 0.165\left(\frac{a}{t}\right)N\right] \qquad \text{Formula 3)}$$

If N, the number of air holes 21, does not satisfy formula (1), the swirling flows 31 jetted out from the plurality of air holes 21 cannot meet each other to form one larger circle or ring of flow. For this reason, the swirling flows 31 cannot envelope the high-temperature combustion gas formed by the circulating flows 32 at the downstream side, and as a result, the high-temperature combustion gas becomes able to leak to the neighborhood of the air hole plate 20. A flame will therefore adhere to the wake flows 33 neighboring the air hole plate 20.

In addition, if the clearance "b" between the air hole inlets facing the fuel nozzle is set to be the same as the clearance "a" between the air hole outlets facing the chamber, the swirling radii of the swirling flows 31 will begin to increase immediately after the swirling flows 31 have been jetted out from the air hole outlets. Near the central axis of the combustor, therefore, an adverse pressure gradient reaching the vicinity of the air hole plate will occur and a positive pressure gradient will not. This will let the high-temperature combustion gas reach the vicinity of the air hole plate. The high-temperature combustion gas, after reaching the vicinity of the air hole plate, will pass through the clearance between the air holes, entering the wake flow regions at the outer circumferential sides, and permitting a flame to adhere to the wake flow regions. Flame adhesion to the wake flow regions at inner circumferential sides will also result.

Furthermore, if the swirling angle θ exceeds the angle defined by formula (3), the combustion gas caused by the circulating flows 32 cannot be enveloped. This is likely to make the high-temperature combustion gas leak to the neighborhood of the air hole plate 20, resulting in the flame adhering to the wake flows 33 at the neighborhood of the air hole plate 20. Moreover, if the swirling angle θ extremely exceeds the angle defined by formula (3), the possible occurrence of interference between the air holes 21 will cause inconvenience such as an event of the air holes communicating with each other.

For these reasons, the air holes are desirably arranged so as to satisfy formulae (1) to (3) shown above.

For an existing combustor with an air hole plate of a flat-plate shape, the effects of the present embodiment can likewise be obtained by replacing the air hole plate with that of the embodiment.

(Second Embodiment)

Figure 5C:
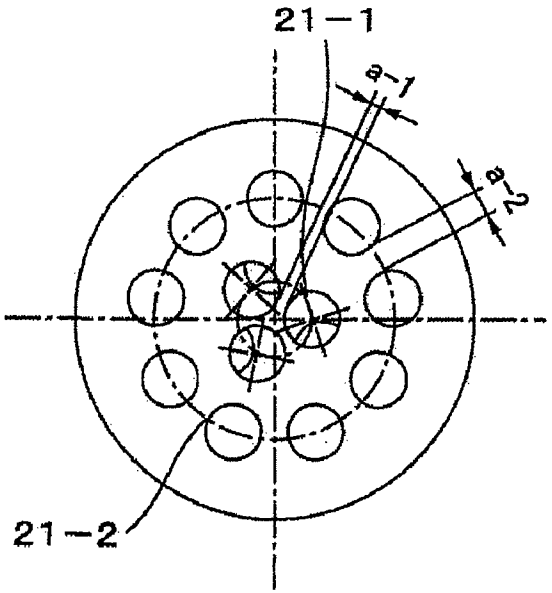
FIGS. 5A to 5C are structural views showing an air hole plate in a second embodiment.
Figure 5B:
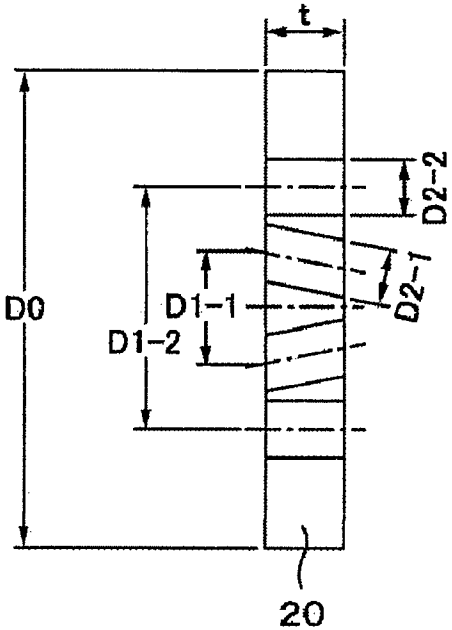
Figure 5A:
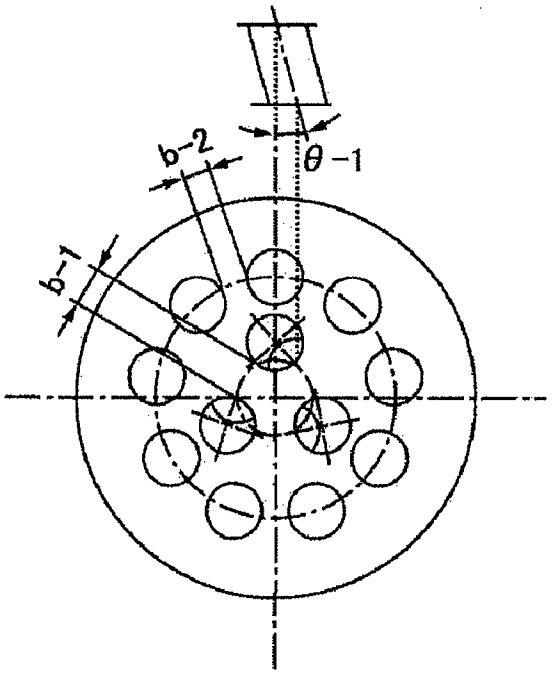

FIGS. 5A to 5C show clearances of the air hole inlets and air hole outlets facing the fuel nozzle and the chamber, respectively, in a second embodiment, and a swirling angle to be assigned to the air holes. The following describes a configurational difference from the first embodiment. The difference in configuration is that three air holes 21-1 provided as a first row of air holes centrally in the air hole plate 20 are surrounded by air holes 21-2 formed as a second row at an outer circumferential side of the air holes 21-1 and in parallel relative to the central axis of the chamber. Because of this arrangement, the outer air holes 21-2 are excluded from adjustment relating to the present invention. Although three air holes 21-1 are arranged in the central section of the air hole plate 20 in the present embodiment, arranging at least four air holes, as in the first embodiment, likewise creates essentially the same effects.

Compared with the first embodiment, the second embodiment has the following advantageous effects. Firstly, the increase in the number of air holes enhances dispersibility of the fuel supplied to the chamber, and hence, improves fuel dispersibility of the combustor. This provides a high degree of fuel-air mixing, allowing reduction in NOx emissions. Secondly, manufacturing costs can be reduced by providing the second row of air holes not limited in air hole clearance and in swirling angle.

Thirdly, if the central air holes 21-1 are constructed with an adjusted swirling angle, the high-temperature combustion gas formed by the circulating flows can be prevented from flowing backward to the air hole plate. Accordingly, even if no swirling angle is assigned to the second row of air holes 21-2, the high-temperature combustion gas by the circulating flows makes no flame adhere to the wake flows occurring at neighboring regions of the second row of air holes. For these reasons, local high-temperature combustion due to the combustion of an incomplete mixture does not occur near the air hole plate 20.

(Third Embodiment)

Figure 6A:
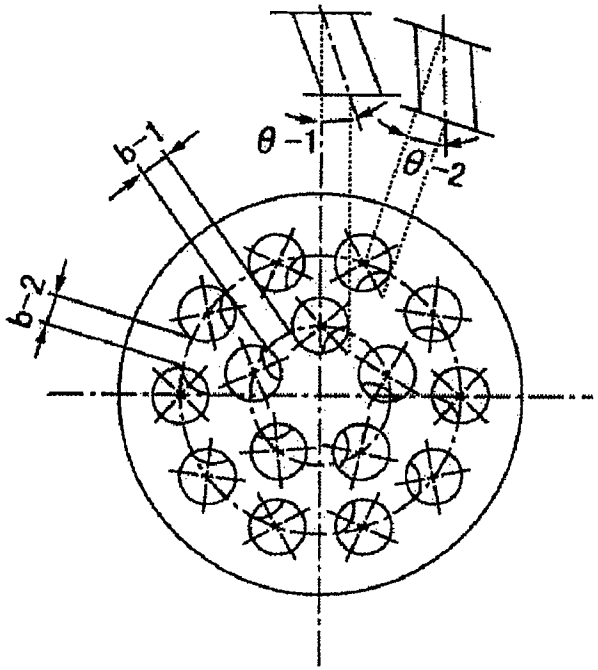
FIGS. 6A to 6C are structural views showing an air hole plate in a third embodiment.
Figure 6B:
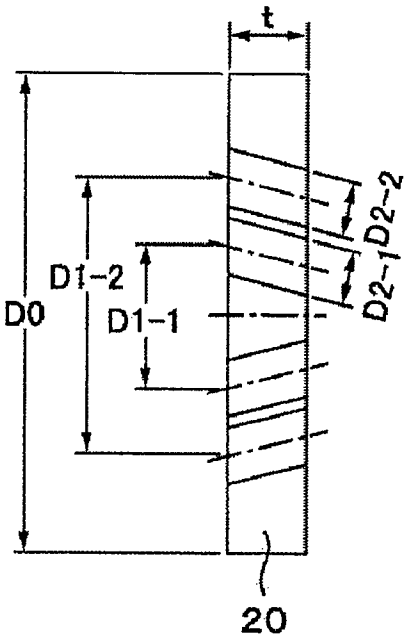
Figure 6C:
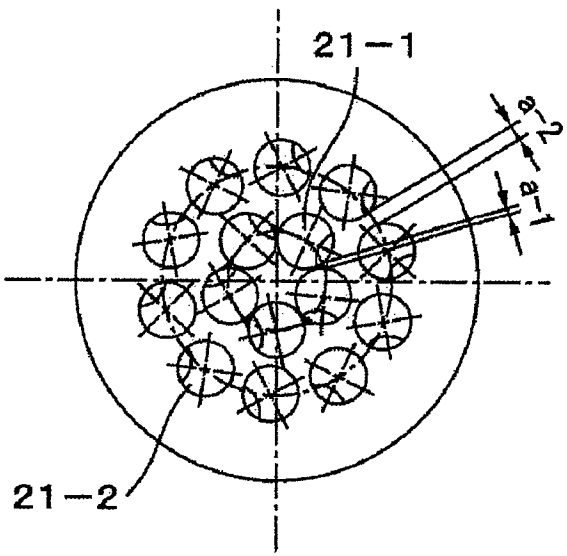

FIGS. 6A to 6C show clearances of the air hole inlets and air hole outlets facing the fuel nozzle and the chamber, respectively, in a third embodiment, and a swirling angle to be assigned to the air holes. The following describes configurational and operational differences from the second embodiment. One difference in configuration exists in that five air holes 21-1 provided as a first row of air holes centrally in the air hole plate 20 are surrounded by ten air holes 21-2 formed as a second row at an outer circumferential side of the air holes 21-1. Another difference is that the air holes 21-2 are also subjected to the adjustment relating to the present invention. Although five air holes 21-1 are provided centrally in the air hole plate 20 of the present embodiment, since $(D2-1/t)=0.65$, $(a-1/t)=0.0489$, a value of $N>2.33$ that satisfies formula (1) can be obtained by providing at least three air holes ($N=3$ or more) to achieve essentially the same effects as those described above. Essentially the same effects can likewise be obtained for the air holes 21-2 in the second row by selecting any other value that satisfies formula (1).

In the present embodiment, swirling flows 31 are also supplied from the second row of air holes 21-2 to the chamber. This means an increase in total angular momentum brought about by all swirling flows. Of all pressure gradients occurring on the central axis of the combustor, therefore, at least the favorable pressure gradient in the vicinity of the air hole plate is strengthened according to the principle of superposition. The adverse pressure gradient occurring in the region enlarged after the swirling flows have conducted the closest approaches to each other is likewise strengthened. Since the favorable pressure gradient is strengthened, the effect of preventing the circulating high-temperature combustion gas from leaking to the vicinity of the air hole plate is enhanced, even in the event of a disturbance such as a fluctuation in air flow rate. In addition, since the second row of air holes 21-2 on the air hole plate face nearer to the chamber are opened in a radial position closer to the first row of (central) air holes 21-1, the clearances between the second row of air holes are smaller and the effect of preventing flame adhering to the wake flows near the air hole clearances can be obtained more strongly and with higher stability. Furthermore, since the adverse pressure gradient occurring in the region enlarged upon the closest approaches of the swirling flows is also strengthened, the circulating flow that is the reflux of the high-temperature combustion gas towards the stagnation region 34 stabilizes and flame stability also improves.

(Fourth Embodiment)

Figures 7A, 7B, 7C:
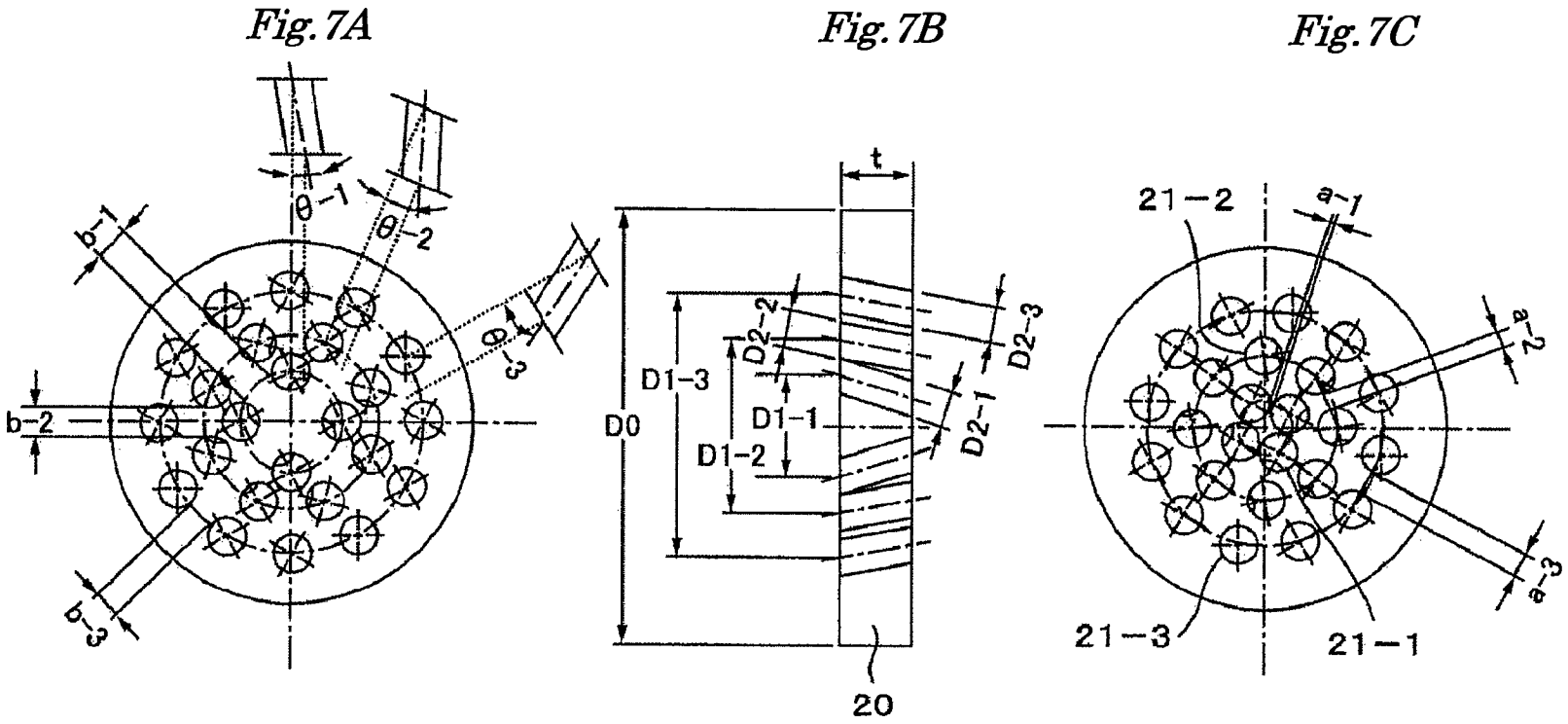
FIGS. 7A to 7C are structural views showing an air hole plate in a fourth embodiment.

FIGS. 7A to 7C show clearances of the air hole inlets and air hole outlets facing the fuel nozzle and the chamber, respectively, in a fourth embodiment, and a swirling angle to be assigned to the air holes. The following describes configurational and operational differences from the third embodiment. One difference in configuration exists in that four air holes 21-1 provided as a first row of air holes centrally in the air hole plate 20 are surrounded by eight air holes 21-2 formed as a second row and twelve air holes 21-3 formed as a third row, at an outer circumferential side of the air holes 21-1. Another difference is that the first row, second row, and third row of air holes are subjected to the adjustment relating to the present invention. In addition, the air holes 21-1, 21-2, and 21-3 are of a greater swirling angle in that order. As in the first to third embodiments, the number of air holes arranged in the same radial position can be any other value falling within the range that satisfies formula (1). As is evident from formula (3), arranging a larger number of air holes in the second row and in the third row will correspondingly augment a maximum usable swirling angle. In the present embodiment, a larger number of air holes are opened in positions closer to an outer edge of the air hole plate, so even when the adjustment relating to the present invention is adopted, a larger swirling angle advantageous for maintaining flame stability can be used and even more stable combustion obtained.

Compared with the embodiment of FIGS. 6A to 6C, the present embodiment has the following advantageous effects: since swirling jets assigned a greater swirling angle are supplied from the outer circumferential air holes 21-2 and 21-3 of greater swirling radii, stronger pressure gradients can be produced, which is advantageous for stabilizing the circulating flows and for strengthening the favorable pressure gradient occurring in the vicinity of the air hole plate.

(Fifth Embodiment)

Figure 8:
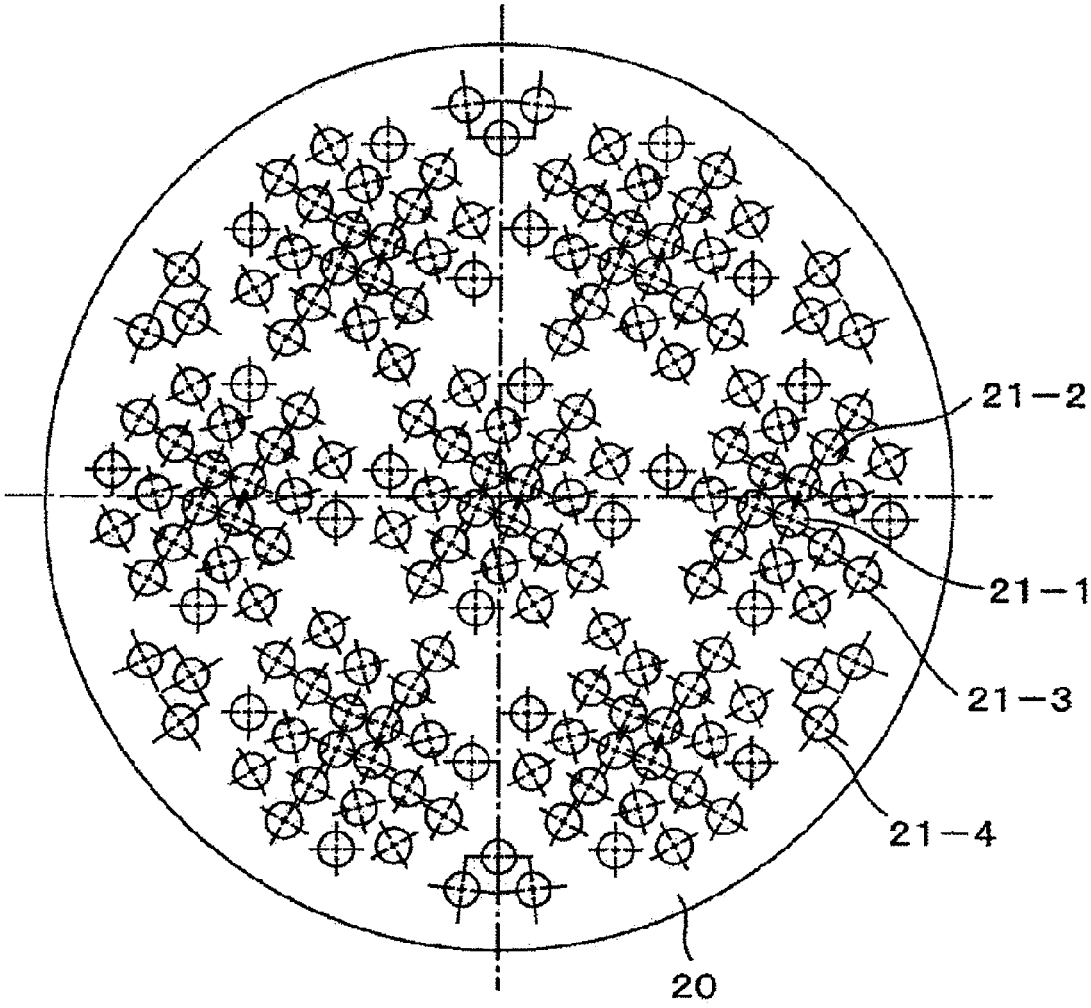
FIG. 8 is a structural view showing an air hole plate in a fifth embodiment.
Figure 9:
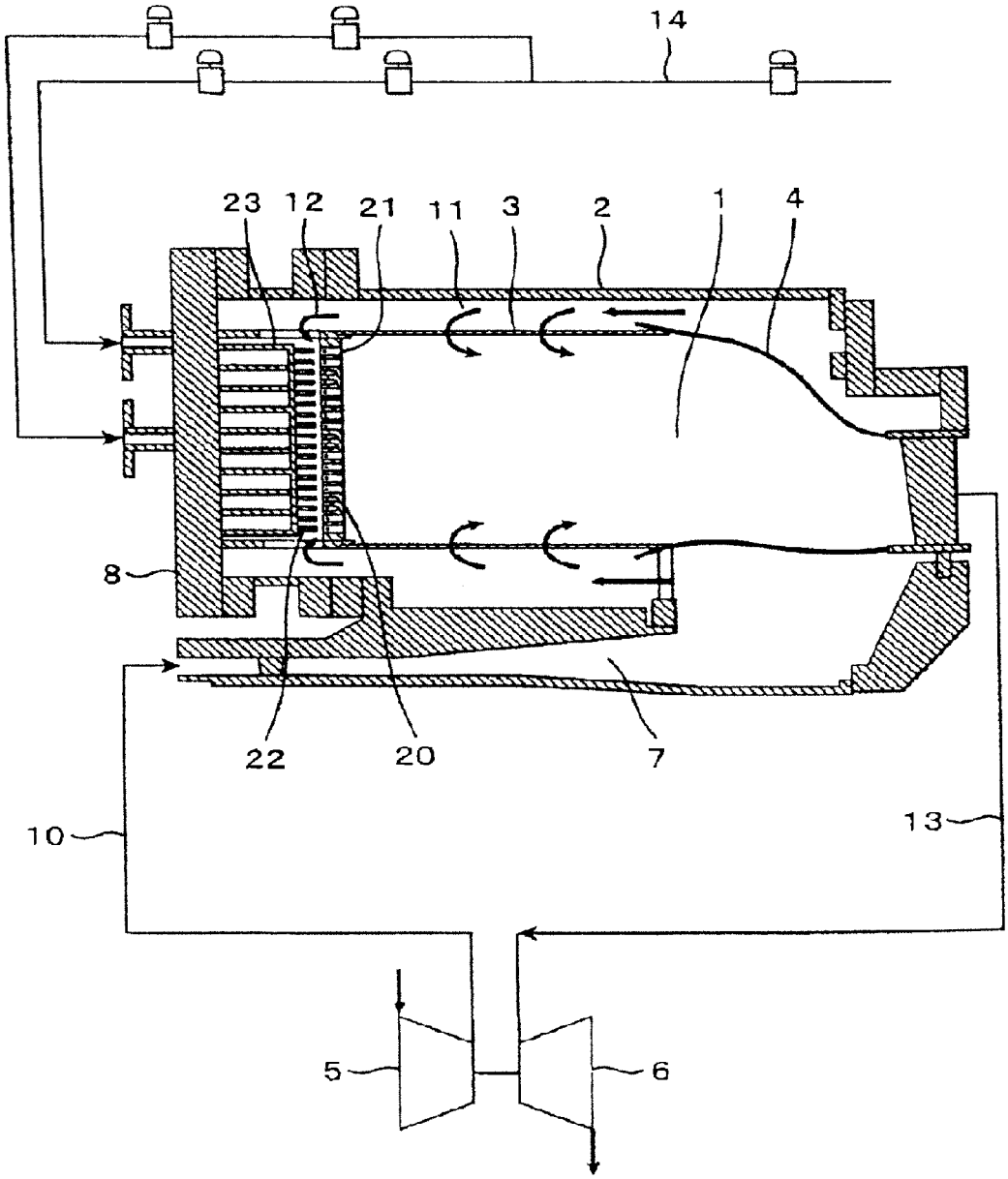
FIG. 9 is a diagram showing a cross section of the combustor in the fifth embodiment, and a system of a compressor and turbine therein.

FIG. 8 is a front elevation of the air hole plate 20 as viewed from the chamber in a fifth embodiment. The present embodiment is suitable for gas turbines adapted for a relatively heavy load. The following describes configurational and operational differences from the fourth embodiment. The present embodiment differs from the fourth embodiment firstly in that one burner of the fourth embodiment is surrounded by six more burners. Air holes 21-3 provided as a third row in this case, however, includes six pieces opened at where the central burner and the outer burners interfere with each other, and six more pieces opened at where the outer adjacent burners interfere with each other. Because of that, the 12 air holes, 21-3, are removed and alternatively thereto, 18 air holes, 21-4, are arranged perpendicularly to the air hole plate 20. A swirling angle, for example, is not assigned to the air holes 21-4. In addition, the central burner and the outer burners positioned therearound are each formed with an independent fuel supply line. A system configuration of a gas turbine employing the combustor of the present embodiment is shown in FIG. 9. Schematically, the configuration is essentially the same as the gas turbine system shown in FIG. 3, except that the supply line for the fuel 14 is divided into a line for supplying the fuel to the central burner, and a line for supplying the fuel to each outer burner.

Compared with the embodiment of FIGS. 7A to 7C, the present embodiment has the following advantageous effects. Firstly, by taking the configuration according to the present invention, the burners constituting the combustor shown in FIG. 8 can suppress flame adhesion at the air hole clearances and thus burn the fuel at low NOx emission levels. Secondly, independent control with the two fuel lines can be used to achieve lower-NOx combustion for response to a wider range of loads. While the fuel supply line is of the dual configuration in the present embodiment, a wider degree of freedom of operation can be realized by using at least three lines.

What is claimed is:

1. A combustor comprising:

a fuel nozzle for jetting out a hydrogen-containing fuel into a combustion chamber formed at a downstream side;

an air hole plate of a flat-plate shape disposed between the fuel nozzle and the chamber, the air hole plate facing an upstream side of the chamber;

a plurality of air holes provided in the air hole plate, which are inclined in a circumferential direction relative to a central axis of the air hole plate, such that a fuel flow and an air flow formed at an outer circumferential side of the fuel flow are blown out into the chamber from the respective air holes;

the plurality of air holes are disposed in a plurality of rows on the air hole plate in a radial direction relative to the central axis of the air hole plate;

wherein a clearance defined between any two circumferentially adjacent air hole inlets provided on a face of the air hole plate that is nearer to the fuel nozzle is formed wider than a clearance defined between any two circumferentially adjacent air hole outlets formed on a face of the air hole plate that is nearer to the chamber;

the plurality of rows each having circumferentially inclined holes to form a swirling flow in the combustion chamber;

the swirling flow forming a stagnation point within the combustor along a central axis of the combustor and a recirculation flow downstream of the stagnation point; and when a number of air holes is taken as N (N is more than four), a thickness of the air hole plate, as "t", a diameter of the air holes, as D2, the clearance between any two air hole outlets on the air hole plate face nearer to the chamber, as "a", the clearance between any two air hole inlets provided on the air hole plate face nearer to the fuel nozzle, as "b", and a swirling angle imparted to the air holes, as "θ", the relationship shown in the following formulas (1) to (3) are satisfied:

$$N > \frac{1}{0.615\left(\frac{D2}{t}\right) + 0.594\left(\frac{a}{t}\right)} \quad \text{(Formula 1)}$$

$$\frac{1}{\left\{0.786\left(\frac{a}{t}\right)^5 - 2.46\left(\frac{a}{t}\right)^4 + 2.98\left(\frac{a}{t}\right)^3 - 1.79\left(\frac{a}{t}\right)^2 + 0.581\left(\frac{a}{t}\right) + 0.0115\right\}N \times a} < \frac{1}{b} \quad \text{(Formula 2)}$$

$$\frac{1}{b} < \frac{1}{\left\{0.105\left(\frac{a}{t}\right)^3 - 0.247\left(\frac{a}{t}\right)^2 + 0.226\left(\frac{a}{t}\right) + 0.00215\right\}N \times a}$$

$$\theta < \sin^{-1}\left[\left\{-0.232\left(\frac{a}{t}\right) + 0.156\right\}\left(\frac{D2}{t}\right)N + 0.165\left(\frac{a}{t}\right)N\right]. \quad \text{(Formula 3)}$$

2. The combustor according to claim 1, wherein a plurality of air holes at an outer circumferential side have a larger swirling angle than a plurality of air holes at an inner circumferential side.

* * * * *